US006200644B1

(12) United States Patent
Ulfstedt et al.

(10) Patent No.: US 6,200,644 B1
(45) Date of Patent: Mar. 13, 2001

(54) METHODS FOR MANUFACTURING PACKAGING BOARD

(75) Inventors: Jack Owe Lennart Ulfstedt, Turku; Liisa Marjatta Kukko, Parainen; Tapani Penttinen, Huutjärvi, all of (FI)

(73) Assignees: Stora Enso Oyi, Helsinki; Oy Zeus Ultrastructures Ab, Parainen, both of (FI)

( * ) Notice: Subject to any disclaimer, the term of this patent is extended or adjusted under 35 U.S.C. 154(b) by 0 days.

(21) Appl. No.: 09/308,494

(22) PCT Filed: Nov. 17, 1997

(86) PCT No.: PCT/FI97/00700

§ 371 Date: Jul. 14, 1999

§ 102(e) Date: Jul. 14, 1999

(87) PCT Pub. No.: WO98/22656

PCT Pub. Date: May 28, 1998

(30) Foreign Application Priority Data

Nov. 22, 1996 (FI) ..... 964661

(51) Int. Cl.[7] ..... B05D 3/02; B05D 3/06

(52) U.S. Cl. ..... 427/487; 427/387; 427/391; 427/393.4; 428/448; 428/452; 428/537.5

(58) Field of Search ..... 427/387, 391, 427/393.4, 487; 428/448, 452, 537.5

(56) References Cited

U.S. PATENT DOCUMENTS 4,206,249 6/1980 Suzuki et al. .
5,340,620 8/1994 Lucas et al. .
5,434,007 * 7/1995 Yeh ..... 427/372.2

FOREIGN PATENT DOCUMENTS 4020316 1/1992 (DE) .
4025215 2/1992 (DE) .
0167881 1/1986 (EP) .
5-032916 * 2/1993 (JP) .
9629205 9/1996 (WO) .

* cited by examiner

*Primary Examiner*—Erma Cameron
(74) *Attorney, Agent, or Firm*—Birch, Stewart, Kolasch & Birch LLP

(57) ABSTRACT

The invention is related to methods for manufacturing liquid-tight and gas-tight packaging board and a package, and products provided according to the said methods. According to the invention, a polymerizing reaction mixture is spread on paper or a board base of paperboard or cardboard, the mixture containing at least one silicon compound forming an inorganic, chain or crosslinked polymeric backbone containing alternating silicon and oxygen atoms, and at least one reactive, organic compound forming organic side chains and/or crosslinks in the polymeric backbone. The reaction mixture may form a colloidal solution in which, along with the polymerization, gelling takes place, whereupon the thus created gel is dried, densified and cured to form a liquid-tight and gas-tight layer of coating. In addition to oxygen and silicon, the said chain-like or crosslinked polymeric backbone can contain metal atoms which replace the silicon, and the organic compound can contain, as a reactive group, an epoxy, an amino, a carboxyl, a carbonyl, a vinyl or a methacrylate group. Furthermore, a joint-forming polymeric coating can be spread on the previously obtained, tight glassy layer of coating to close the manufactured package. Products, to which the paper or the board coated according to the invention can be applied, include milk and juice containers or similar packages of liquid foodstuffs, bag-type foodstuff packages, heat-sealed, peelable covers of containers and boxes, and microwave and conventional oven trays.

21 Claims, 1 Drawing Sheet

METHODS FOR MANUFACTURING PACKAGING BOARD

This application is the national phase under 35 U.S.C. §371 of prior PCT International Application No. PCT/FI97/00700 which has an International filing date of Nov. 17, 1997 which designated the United States of America.

The object of the invention is a method for manufacturing packaging board, in which a board base of paperboard or cardboard is provided with at least one silicon-based, liquid-tight and gas-tight layer of coating. Another object of the invention is a method based on the coating of paper or a board base to manufacture liquid-tight and gas-tight packages, and products provided by using the methods, including foodstuff packages and trays.

In order to be useful, for packages of liquid and other wet foodstuffs or foodstuffs which spoil easily the board or the paper must be provided with a liquid-tight and gas-tight coating. The coating prevents the oxygen in the air from penetrating the package and spoiling the product, and it also prevents the package from getting wet and the aromas of the product escaping from the package. Corresponding gas tightness can be required from medicine, cosmetics, and detergent packages.

An effective way to render liquid packages, such as juice containers, liquid-tight and gas-tight is to provide the board of the container with a thin aluminium foil. Aluminium as such has also been used for peelable covers of yoghurt and curdled milk cups and butter and margarine boxes. However, aluminium foil has disadvantages: high manufacturing costs, it is not biologically decomposable, there are difficulties in regenerating the packaging material, and the package cannot be heated in a microwave oven. Another problem with detachable aluminium covers is that they tear and burst easily.

An alternative solution for tightening the board or the paper used for packages is to provide it with one or more layers of polymeric coating. The number of layers and the material used depend on the requirements set by the packaged product. The best coating materials have essentially reached a tightness corresponding to that of aluminium foil and, as substitutive materials, they have eliminated the above-mentioned disadvantages connected with aluminium. However, it has been necessary to combine various polymeric materials in these substitutive solutions so that they comprise, for example, an oxygen-tight, water vapor-tight, and aroma-tight barrier layer, heat-seal layers on both sides of the paper or the board, and one or more layers of binding material to bind the polymers to the paper or the board and to each other. Therefore, the structure of the packaging paper or board becomes complex and the consumption of polymeric material is extensive.

Examples of packages tightened according to the above description include containers which are intended to be used as packages of milk, cream, sour milk, juice or other similar, liquid foodstuffs and which are entirely made of board provided with layers of polymeric coating. In these containers, the board is typically provided with four or even five layers of polymeric coating so that, for example, the board comprises an oxygen-tight and aroma-tight barrier of, e.g., polyamide, a layer of binding material on top of that, and, at the very top, a heat-seal layer of polyethylene, for example, and another heat-seal layer of polyethylene is provided on the opposite side of the board. Another typical package application is a portion package of, for example, milk, curdled milk, yoghurt, water, juice, desserts or ice-cream, in which the package is in the form of a small cup or a container, is typically made of plastic or coated paperboard, and is provided with a heat-sealed, peelable cover. The cover material is paper which is coated with an oxygen-tight and aroma-tight barrier consisting of, for example, polyamide, ethylene vinyl alcohol copolymer (EVOH) or polyethylene terephtalate (PET), with a layer of binding material, and with a heat-seal layer which is against the mouth of the container or the cup and which consists of, for example, styrene-modified copolymer of ethylene and methacrylic acid, making the product both heat-sealable and easy to be peeled off. Cosmetic products and pharmaceutical pills have been packed in a similar manner, using plastic or glass containers provided with a peelable paper cover which is sealed with a polymeric coating.

Patent publication U.S. Pat. No. 5,340,620 describes paperboard provided with a silicon-based polymeric coating, in which the polymer serves as an oxygen-tight barrier. According to the publication, the coating is provided by polymerizing organosilane by using UV irradiation, whereby, in addition to an inorganic polymeric backbone, organic bonds are formed in the coating when the organic groups of the silane react with each other. However, the portion of the inorganic polymeric backbone is prevalent in the coating, which is why it can be too fragile to withstand, for example, the creasing which is part of the manufacture of paperboard or cardboard containers; furthermore, there is no mention of the water vapor-tightness of the coating. It is obvious that the coating material of the embodiment of the publication cannot provide paperboard or cardboard suitable for liquid packages. Moreover, organosilanes are an expensive raw material for the coating.

Silicon-based coatings have also been described e.g. in the published applications DE 4 020 316 and 4 025 215, which cite paper as one possible substrate of the coating but which describe in detail the coating of plastic or metal only, and according to the publications, the purpose of the coating is to provide resistance to wear so that the film-like substrate still maintains its flexibility. Therefore, the publications are not concerned with packaging technology which is the object of the present invention.

Another use of tightened packaging board are foodstuff underlayers, such as ovenable microwave or conventional oven trays which can be part of consumer packages of foodstuffs, such as casserole foods intended to be heated, or which can be sold as separate products. Such underlayers must be impermeable to water and grease; and in addition to this, sufficient heat-resistance is required from ovenable trays. Polyester coated paperboard has been used in oven trays; however, its disadvantages include the thickness of the required polymeric layer and the fact that it is very difficult for the polymeric coating to withstand typical oven temperatures of more than 200° C. Polypropylene has been used as the polymer coating in microwave ovenable trays.

The purpose of the invention is to present a new solution to provide a board base of paperboard or cardboard intended to be used as packaging material with a polymeric layer of coating which renders the package liquid-tight and gas-tight. The purpose is particularly to provide a simple structure of coated board and savings in coating material, while at the same time making the coating tough enough to withstand the creasing required of paperboard or cardboard containers without breaking. The invention is characterized by the steps of providing a polymerizing reaction mixture containing at least one silicon compound to form an inorganic, chain-like or crosslinked polymeric backbone containing alternating silicon and oxygen atoms, and at least one reactive organic compound to form organic side chains and/or crosslinks to the polymeric backbone, spreading said mixture on the board base, and curing said mixture to form a layer of coating.

The process according to the invention can be implemented, starting from a silicon compound, such as silane, an organic compound reacting with it, water, and a possible catalyst, whereby the hydrolyzed groups of the silicon compound are first partly condensed, forming colloidal particles in the solution. With the sol ageing and/or with a catalyst being added, the reaction continues with the particles growing and being combined, resulting in a chained or crosslinked gel covering the surface of the board, the gel being finally dried and cured by heating or irradiating it using UV, IR, laser or microwave radiation to form a thin, tight coating on the board. Depending on the circumstances, the curing time may vary from fractions of a second to several hours. The coating thus obtained simultaneously features typical characteristics of both an inorganic and an organic substance, and the properties of the coating can be adjusted particularly by properly selecting the organic component which forms crosslinks or side chains.

The organic compound as used is a purely organic carbon based compound. The organic compound is capable of forming organic, carbon based side chains or crosslinks through the reactive sites of the polymeric backbone formed by the silicon compound. Said organic compounds are thus distinct from the silico-organic compounds such as organosilanes which polymerize by hydrolysis and condesation of the alkoxy groups into an essentially inorganic chain or network structure.

In the invention, a considerable portion of the polymeric layer can be formed of suitable reactive organic compounds which are essentially cheaper than organosilanes. Furthermore, an organic compound, which preferably is added to the reaction mixture at a relatively late stage, advances the completion of the polymerization. The polymeric backbone which is created when only organosilane is used can constitute a steric hindrance to the mutual reactions of the reactive substituents of silane, while a free organic compound which is present is presumably able to continue the reaction even after this, forming more side chains and/or crosslinks between the inorganic silicon-oxygen chains. By adjusting the amount of the organic compound used, the degree of organicity of the coating thus created and the properties depending on it can also be adjusted at the stage of polymerization.

According to the invention, an oxygen-tight and water vapor-tight and tough layer of coating is provided which does not break when bent, withstands creasing, and can be made very thin without creating small visually unperceivable pin holes in the coating, during the forming stage or later when heated or jointed, which constitute a problem in present coating materials and because of which the layers of coating have had to be made relatively thick. On the basis of preliminary tests, a tight layer of coating can be provided on a smooth board base by as low an amount of coating as 1 $g/m^2$, and in practice, a preferred amount of coating is in the range of about 2 to 6 $g/m^2$. A further advantage is that a polymeric sealing layer can be spread directly on top of the silicon-based layer of coating without needing a binding agent between these layers. In known organic coating combinations, simply the weight of a gas-tight barrier which can be made of polyamide, PET or EVOH is typically at least about 20 $g/m^2$, and these materials require a separate layer of binding material between the barrier and the heat-seal layer. Therefore, the invention can be used to accomplish essential savings in material and a decrease in the weight of the board as compared with the said, known technology. Another advantage of the invention is that the spreading of the coating mixture is easy to accomplish using the methods commonly used in paper and paperboard or cardboard industry, such as rod or blade coating techniques or spraying. The spreading of the coating may thus be effected in the board machine by using the "on-line" principle as part of the manufacturing process of the board, by using the same application technology that is used in spreading normal coatings. The coating can also be effected on premoulded tray blanks or in connection with the moulding. When needed, the mixture can be extended with filling material, the most preferable materials including scale- or slate-like filling materials, such as talc, mica or glass flakes. When the coating is formed, these substances settle in the direction of the surface and contribute to its properties of impermeability. The adhesion of the coating to the filling agents is excellent. It is also possible to dye the coating by adding pigments or organic colouring agents to the mixture, or by mixing organic and/or inorganic fibres or particles into the coating formulation, the fastening of which to the coating can be improved by coupling agents. Furthermore, it is possible to include, in the formulation, an organic, polymerizing agent which forms a separate polymeric structure with respect to the inorganic chain or crosslinked structure, according to the invention, and which intermeshes with it. In addition to the board machine, the spreading of the coating can be carried out, in connection with a printing process, for example, on a finished board which does not necessarily have to be dried first. In this case, the board can be precoated with any kind of coating commonly used in paper and board industry.

The chain or crosslinked backbone of the polymeric coating provided according to the invention can consist of silicon and metal atoms and oxygen atoms which alternate with them. Preferably, the structure mainly consists of silicon and oxygen, and fairly small amounts of metal atoms can be combined with the same structure as substituents for the silicon. The metals can preferably include, for example, Ti, Zr, and Al. The organic groups that are combined with the polymeric structure can mainly include substituted or unsubstituted alkyl and aryl groups.

The polymerizing reaction that creates the inorganic polymeric backbone of the coating, according to the invention, can be described by way of an example by the following formula:

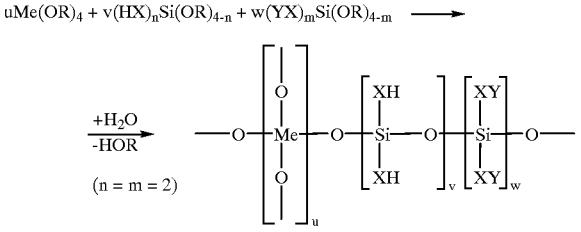

in which:

Me refers to a tetravalent metal atom,

R refers to an alkyl group or hydrogen,

X refers to, for example, an alkyl or aryl body or chain,

Y refers to a reactive substituent which can be, for example, an amino, a hydroxyl, a carbonyl, a carboxyl, a vinyl, an epoxy or a methacrylate group, u, v, and w are integer numbers, and n and m are integers from 1 to 3.

In the organic polymerization of the coating composition which is preferably carried out at the drying and setting stage of the coating, an organic compound can combine with the reactive substituent Y of organosilane to form an organic side chain, by using an addition reaction. The reaction can also be a condensation depending on the reacting groups. The reactive group at the end of the chain can further react with substituent Y of organosilane in the polymerization, whereby an organic crosslink is created between the silicon chains. It is also possible that substituents Y of organosilane react directly with each other to form a crosslink between the silicon chains. The number and the length of the crosslinks, i.e., the degree of organicity of the coating, can be adjusted with the aid of the quality and the fraction of the organic compound included in the reaction mixture. Particularly suitable crosslinking organic compounds include epoxides which contain two epoxy groups in an alkyl or aryl body or chain, and diols.

The liquid medium needed in the process according to the invention may contain, for example, water, alcohol, and/or liquid silane. The hydrolyzation carried out in the above reaction example binds water, providing that water is present, while at the same time alcohol is released in the reaction, converting into a liquid phase.

Organosilanes which comprise hydrolyzing and condensing groups, or their hydrolyzates are suitable for starting materials of the process according to the invention.

Correspondingly, compounds containing metal centre atoms, such as Zr, Ti, Al, B, etc., or compounds of these metals and silicon, or mixtures of the compounds can be used. E.g. silanes of the following type can be used:

$$(YX)_a(HX^1)_bSi(OR)_{4-a-b} \quad (1)$$

in which

Y=a reactive organic group which is an epoxy group, a vinyl group or other polymerizing, organic group, X and $X^1$=a hydrocarbon group containing 1 to 10 carbon atoms, R=a hydrocarbon group containing 1 to 7 carbon atoms, an alkoxyalkyl group or an acyl group containing 1 to 6 carbon atoms, a=number 1 to 3, b=number 0 to 2, providing that a+b≦3.

Organic polymerization can be described by way of an example in the following way:

a) the reactive groups of the organosilane of the coating composition (Y in the above reaction equation) crosslink the coating when they are polymerized.

A polyethylene oxide crosslink formed by epoxy silane is presented as an example:

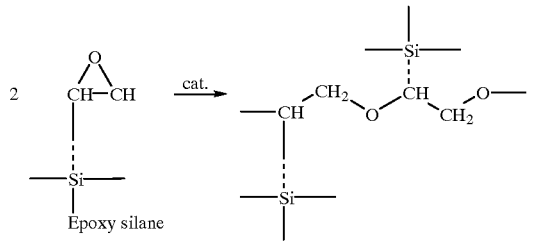

b) the added, organic, reactive prepolymer reacts with the reactive group of the organosilane

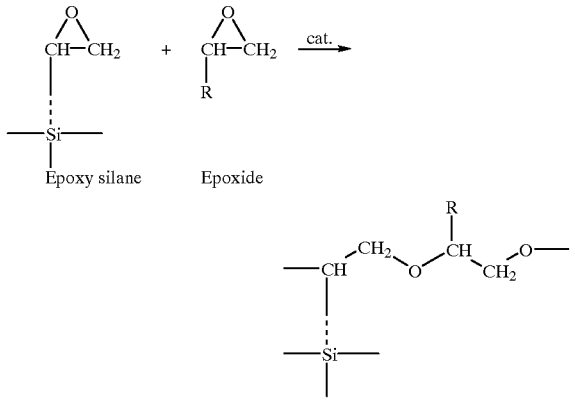

c) the added, organic, polymerizing substance reacts when the molecules of the substance in question polymerize with each other

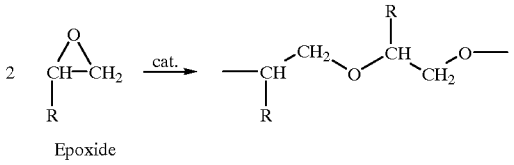

d) all alternatives a, b, and c can have an effect together.

The number and the length of the crosslinks, i.e., the degree of organicity of the coating can also be adjusted by the quality and the fraction of the organic compound included in the reaction mixture. The organic compound can be a monomer which can be prepolymerized to a varying degree and/or combined with the silane at the time of spreading the mixture. The organic compound can also be in the form of a prepolymer when added to the reaction mixture. The amount of the organic compound can be, calculated as a monomer, 5 to 80, preferably 10 to 70, and most preferably 10 to 50 molar percent of the total amount of the polymerizing starting materials of the reaction mixture.

The epoxysilanes according to formula (1), containing one glycidoxy group can include, for example: glycidoxymethyltrimethoxysilane, glycidoxymethyltriethoxysilane, β-glycidoxyethyltriethoxysilane, β-glycidoxyethyltrimethoxysilane, γ-glycidoxypropyltrimethoxysilane, γ-glycidoxypropyltriethoxysilane, γ-glycidoxypropyltri(methoxyethoxy)silane, γ-glycidoxypropyltriacetoxysilane, δ-glycidoxybutyltrimethoxysilane, δ-glycidoxybutyltriethoxysilane, glycidoxymethyldimethoxysilane, glycidoxymethyl(methyl)dimethoxysilane, glycidoxymethyl(ethyl)dimethoxysilane, glycidoxymethyl(phenyl)dimethoxysilane, glycidoxymethyl(vinyl)dimethoxysilane, β-glycidoxyethyl(methyl)dimethoxysilane, β-glycidoxyethyl(ethyl)dimethoxysilane, γ-glycidoxypropyl(methyl)dimethoxysilane, γ-glycidoxypropyl(ethyl)dimethoxysilane, δ-glycidoxybutyl(methyl)dimethoxysilane and δ-glycidoxybutyl(ethyl)dimethoxysilane.

Silanes containing two glycidoxy groups can include, for example: bis-(glycidoxymethyl)dimethoxysilane, bis-(glycidoxymethyl)diethoxysilane, bis-(glycidoxyethyl)

dimethoxysilane, bis-(glycidoxyethyl)diethoxysilane, bis-(glycidoxypropyl)dimethoxysilane, and bis-(glycidoxypropyl)diethoxysilane.

Examples of compounds according to formula (1), containing other reactive groups include: vinyltriethoxysilane, vinyl-tris(β-methoxyethoxy)silane, vinyltriacetoxysilane, γ-methacryloxypropyltrimethoxysilane, γ-aminopropyltriethoxysilane, N-β-(aminoethyl)-γ-aminopropyltrimethoxysilane, N-bis(β-hydroxyethyl)-γ-aminopropyltriethoxysilane, N-(β-aminoethyl)-γ-aminopropyl(methyl)dimethoxysilane, γ-chloropropyltrimethoxysilane, γ-mercaptopropyltrimethoxysilane and 3.3.3-trifluoropropyltrimethoxysilane.

Examples of silicon compounds which are described by general formula (2)

$$(HX)_nSi(OR)_{4-n} \quad (2)$$

include dimethyldimethoxysilane, methyltrimethoxysilane, tetraethoxysilane, phenyltrimethoxysilane and phenylmethyldimethoxysilane.

These compounds can be used as separate components or as mixtures of two or more compounds.

Other possible compounds include, for example, colloidal silica, i.e., a colloidal solution which contains a certain fraction of very fine-grained silica-anhydride powder and which is dispersed in water or alcohol, for example, and in which the particle diameter is preferably 1 to 100 nm.

Prepolymers can be used as crosslinking organic compounds and the reactive groups of organosilanes preferably react with the prepolymers so that similar reactive groups react mutually to form crosslinks which combine inorganic oxygen silicon chains. For example, epoxide resin or aromatic diols can be used to react with silanes containing epoxy groups.

Aromatic alcohols, such as Bisphenol A, Bisphenol S, and 1.5-dihydroxy naphtalene can be used as diols. Acrylates can be used to react with silanes containing acrylic groups or acryloxy groups. Prepolymers which have reactive double bonds are used with vinyl silanes or other silanes containing polymerizable double bonds, as well as with silanes containing mercapto groups. Polyols are used with silanes containing isocyanate groups. Isocyanates are used with silanes containing hydroxy groups and epoxide resin is used with aminosilanes.

Mineral fillers, such as talc and mica can be used as filling material. Furthermore, coupling agents, tensides, and other additives which are used to prepare composites and coatings can be added to the mixture.

The hydrolyzates of the silicon compounds according to formulas (1) and (2) can be manufactured by hydrolyzing corresponding compounds in a solvent mixture, such as a mixture of water and alcohol in the presence of acid, of which the method is commonly known. When the silicon compounds according to general formula (1) and (2) are used in the form of hydrolyzates, a better result is generally obtained by mixing and hydrolyzing the silanes together.

A curing catalyst makes the coating cure at a relatively low temperature and has an advantageous effect on the properties of the coating.

The following substances, for example, can be used as the curing catalysts of silanes containing epoxy groups: Broensted acids, such as hydrochloric acid, nitric acid, phosphoric acid, sulphuric acid, sulphonic acid, etc.; Lewis acids, such as $ZnCl_3$, $FeCl_3$, $AlCl_3$, $TiCl_3$, and the metal salts of these organo complex acids, such as sodium acetate, and zinc oxylate; organic esters of boric acid, such as methyl borate and ethyl borate; alkalis, such as sodium hydroxide and caustic potash; titanates, such as tetrabutoxy titanate and tetraisopropoxy titanate; metal acetyl acetonates, such as titanyl acetyl acetonate; and amines, such as n-butyl amine, di-n-butyl amine, guanidine, and imidazole.

Latent catalyzers can possibly also be used, such as salts of inorganic acids and carboxylic acids, such as ammonium perchlorate, ammonium chloride, and ammonium sulphate, ammonium nitrate, sodium acetate, and aliphatic fluorosulphonates.

The selection of the most suitable curing catalyst depends on the desired properties and the use of the coating composition.

Furthermore, the coating can contain solvents, such as alcohols, ketones, esters, ethers, cellosolves, carboxylates or their mixtures. Lower alcohols from methanol to butanol are particularly recommended. Methyl cellosolve, ethyl cellosolve, and butyl cellosolve, lower carboxylic acids and aromates, such as toluene and xylene, and esters, such as ethyl acetate and butyl acetate, are also commonly used. However, the use of solvents is preferably minimized, for example, by using silanes as solvents because the evaporation of solvent vapors in connection with the coating of the paperboard causes extra arrangements.

To obtain a smooth coating, a small amount of a flow regulating agent (such as block-copolymer of alkylenedioxide and dimethylsiloxane) can be added if needed.

Antioxidants and substances which protect against UV-light can also be added to the coating.

Non-ionic tenside can be added to the coating solute to adjust its wetting properties and hydrophilic properties.

The silicon-based coating layer provided according to the above description has a glassy outward appearance and it is also tight and flexible, does not crack or form holes, is heat-resistant and chemically resistant. The coating is oxygen-tight, grease-tight, aroma-tight, and water vapor-tight, and it is not sensitive to moisture. In the recycling of material carried out by pulping, the minor amounts of coating material present do not harm the recycled pulp thus obtained.

The curing of the coating layer and removing the remaining liquid phase are preferably carried out by heating the coating to a temperature range of about 100 to 200° C. Heating removes the porosity from the coating, giving it the required liquid-tightness and gas-tightness.

As mentioned earlier, a joint-forming polymeric coating can be spread on top of the layer of coating provided according to the invention without a laminating adhesive between the layers. For example, when container-type packages are manufactured from paperboard or cardboard, the heat-sealing polymer serves as an adhesive that seals the joints of the container. To ensure the tightness of the joints, both sides of the board are preferably coated with heat-sealing polymer.

As the thin, glassy coating layer provided according to the invention is transparent, the pictures and the text that have been printed on the board before the coating process will be visible. This is an advantage in food trays in which the glassy coating constitutes the outer surface of the product.

The coated packaging board manufactured according to the invention can be used as the oxygen-tight and aroma-tight material of containers or small cups intended for packages of liquid foodstuffs. The layer of coating withstands, without breaking, the creasing of the coated paperboard to provide the edges of containers which have the shape of a rectangular prism or a tetrahedron.

Another special application of the packaging board coated according to the invention is grease-tight, heat-resistant material of foodstuff bases, such as microwave or conventional oven trays. In this case, too, the paperboard is subjected to creasing and folding and the coating must withstand the treatment without breaking. Furthermore, one special advantage of the coating of ovenable trays, provided according to the invention, is the good heat-resistance of the coating. The paperboard can be shaped into a tray by pressing at a high temperature and the trays easily withstand the normal temperatures of kitchen stoves and microwave ovens, and even temperatures exceeding 300 ° C. at which the paperboard will begin to char. At the same time, the layers of coating protect the paperboard from the softening effect of steam coming from the food when heated so that the tray maintains its form. When baked, the food does not stick to the coating according to the invention. The tray provided in accordance with the invention can be part of the consumer packaging of prepared food, for example, whereby the food is intended to be heated in the tray after opening the package, or the trays can be sold to consumers as such.

Furthermore, the invention comprises a method for manufacturing a liquid-tight and gas-tight package, which is characterized in that a polymerizing reaction mixture is spread on paper or a board base of paperboard or cardboard, said mixture comprising at least one silicon compound forming an inorganic, chain or crosslinked polymeric backbone which contains alternating silicon and oxygen atoms, and at least one reactive, organic compound forming organic side chains and/or crosslinks to the polymeric backbone, that the reaction mixture is cured to form a layer of coating, and that the package is partly of fully formed of the thus obtained polymer coated paper or board.

It should be mentioned in this context that the board base in the present invention refers to a fairly stiff fibre-based packaging material which is sufficiently self-supporting to be suitable for container-like packages or foodstuff bases, for example, which are manufactured entirely of the said material. The weight of such a board is at least about 170 g/m$^2$, and generally in the order of 225 g/m$^2$ or higher. A board in the weight range of 170–250 g/m$^2$ is conventionally referred to as paperboard and a board having a weight of 250 g/m$^2$ or more is referred to as cardboard. The paper in the invention refers to a thinner and lighter fibre-based material which is suitable packaging material, for example, for heat-sealed, peelable covers of portion packages or boxes.

What is presented above in connection with the manufacturing method of packaging board according to the invention, is mainly applicable as such to the manufacturing method of the package according to the invention. This is related, for example, to the forming of the silicon-based layer of coating, its chemical structure and composition, and to a possible spreading of a jointing polymeric coating on top of the glassy silica coating.

Products according to the invention, manufactured according to the methods described above, include particularly sealed paperboard and cardboard packages of liquid foodstuffs, such as milk, cream, sour milk or juice containers and small cups, sealed paper foodstuff packages, such as soup mix powder pouches, coffee, and spice packages, paperboard microwave or conventional oven food trays which can be part of prepared food packages, paperboard or cardboard detergent packages, and the heat-sealed paper covers of glass, plastic or paperboard foodstuff, medicine, and cosmetics packages, particularly the covers of yoghurt, milk, juice, water, ice-cream or dessert cups, and those of curdled milk containers or butter, margarine or prepared foodstuff boxes.

Figure 1:
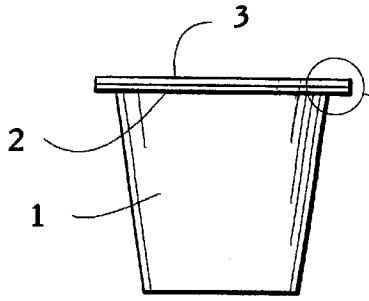
FIG. 1 shows a small yoghurt cup according to the invention which is provided with a heat-sealed cover paper.
Figure 2:
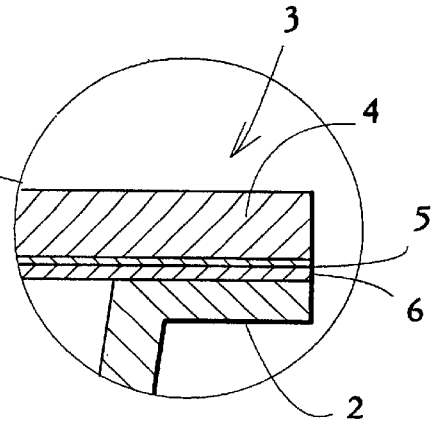
FIG. 2 is a section of the mouth of the cup and the edge of the cover paper as a part enlargement of FIG. 1.

The consumer package of yoghurt according to the invention presented in FIGS. 1 and 2 preferably consists of small plastic cup 1 with an oxygen-tight and aroma-tight cover paper 3 heat-sealed on its mouth 2. Cover paper 3 comprises paper layer 4, silicon-based, oxygen-tight and aroma-tight polymeric layer 5 made by using a sol-gel process, and, for example, heat-seal layer 6 of styrene-modified copolymer of ethylene and methacrylic acid. Heat-seal layer 6 secures cover paper 3 tightly to flange 2 encircling the mouth of the pot. At the same time, heat-seal layer 6 allows cover paper 3 to be peeled when the cup is opened. The weight of paper layer 4 of the cover paper can be, for example, 40 to 80 g/m$^2$, the weight of the oxygen-tight and aroma-tight layer of coating 5 is preferably about 2 to 5 g/m$^2$, and the weight of heat-seal layer 6 can be, for example, about 20 g/m$^2$.

Figure 3:
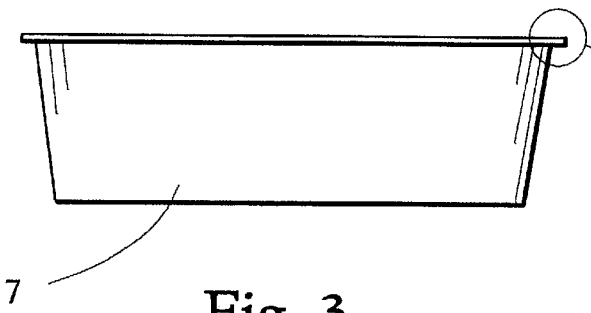
FIG. 3 shows a paperboard ovenable tray according to the invention.
Figure 4:
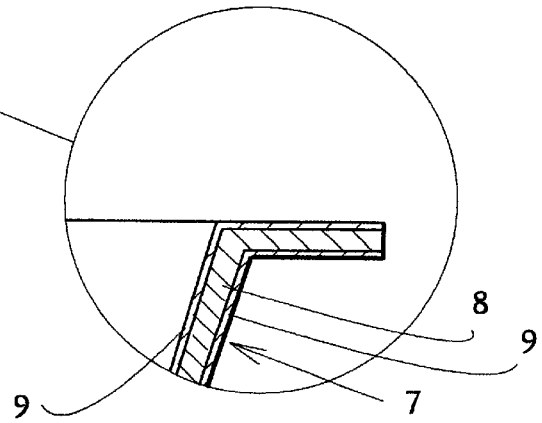
FIG. 4 is a section of the edge of the tray as a part enlargement of FIG. 3.

Ovenable tray 7 according to FIGS. 3 and 4 which can be applied to a package of prepared food, for example, comprises paperboard layer 8 and glassy, silicon-based polymeric layers 9 formed by a sol-gel process on the inner and outer surfaces of the tray. The weight of the paperboard layer is at least about 225 g/m$^2$, and the weight of both glassy polymeric layers 9 is preferably about 2 to 5 g/m$^2$. Polymeric layers 9 render the tray water-tight and grease-tight and they withstand the conventional kitchen stove operating temperatures of 200 to 250° C. without being damaged. The polymeric layer of the inner surface of the tray specifically prevents the food from sticking and the polymeric layer of the outer surface of the tray mainly protects the tray against the grease on the bake sheet and against the splatters coming from the food when heated. In some instances, the polymeric layer of the tray outer surface can be omitted. The illustrated tray 7 as such can also be used in microwave ovens.

Figure 5:
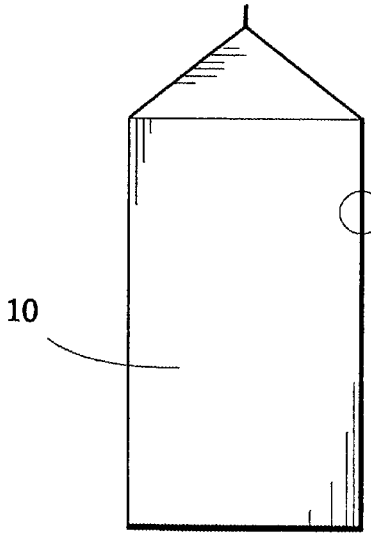
FIG. 5 shows a paperboard milk container according to the invention.
Figure 6:
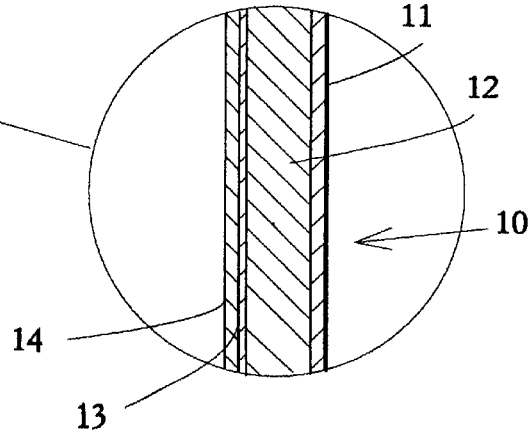
FIG. 6 is a section of the wall of the container as a part enlargement of FIG. 5.

Milk container 10 which is illustrated in FIGS. 5 and 6 and which is mainly shaped as a rectangular prism is made entirely of coated, liquid-tight and gas-tight packaging board. The packaging board comprises a polymeric heat-sealing layer 11 on the outer surface of container 10, paperboard layer 12, a silicon-based, oxygen-tight and aroma-tight polymeric layer 13 made by a sol-gel process and placed inside of the paperboard layer, and a heat-sealing layer 14 which constitutes the inner surface of the container. Heat-sealing layers 11, 14 of e.g. polyethylene at the joints of container 10 secure the overlapping paperboard layers tightly to each other. The weight of paperboard 12 of the container is at least about 225 g/m$^2$, the weight of the oxygen-tight and aroma-tight polymeric layer 13 is preferably about 2 to 5 g/m$^2$, and the weight of both heat-sealing layers 11, 14 is, for example, about 20 g/m$^2$.

The packaging board according to FIG. 6 which constitutes the wall of the container can be provided with an extra polymeric layer (not shown) between paperboard layer 12 and sol-gel layer 13 which possibly also contains pigments and fillers. Examples of preferred polymers include polyolefins and styrene acrylates. The said polymeric layer can be used to decrease the material thickness of sol-gel layer 13 because the polymeric surface is smoother and tighter than the paperboard layer.

The invention and the polymeric coating materials it employs are described by the following application examples.

EXAMPLE 1

Barrier Coating 182 g of 2.2-bis(4-hydroxyphenyl) propane is dissolved by mixing in 473 g of gamma-glycidyloxypropyltrimethoxysilane at room temperature. 24 g of 0.1N hydrochloric acid is gradually added to this mixture, agitating it at the same time. Agitation is continued for about two hours, during which time about 20 g of colloidal silica is added. When needed, 1 g of a flow regulating agent is added. The solution thus prepared is usable for at least one month. 16 g of methyl imidazole (a Lewis acid) is added by mixing for about one hour before the solution is used. This solution is usable for about 24 hours.

The coating was effected by using the rod coating method on the following paperboard grades:

1. Pigment Coated SBS Paperboard
   Basis weight 235 g/m$^2$
   Thickness 314 $\mu$m
2. Styrene Butadiene Dispersion Coated Paperboard
3. Cup Board with Smooth Surface
   Basis weight 230 g/m$^2$
   Thickness~300 $\mu$m The coating was heat-cured in a furnace at 160° C. for 2 minutes.

Test Results

The coating solution according to Example 1 was used in the tests conducted on paperboard grades 1, 2, and 3. The results indicate that the coating solution with this viscosity suited smooth and less porous paperboard grades the best (samples 1 and 2).

When assessed visually, the coating is clear, transparent, and it has a good film forming ability. On the basis of an electron microscope study, the coating in samples 1 and 2 is whole and continuous. The coating in sample 3 is partly absorbed by the pores, causing holes.

The physical properties of the coating are shown in Table 1.

TABLE 1

The test results of Example 1

| Paper-board grade | Thickness of coating $\mu$m | Penetration of water vapor g/m$^2$/24 h, 23° C., 50% RH | Pene-tration of oxygen cm$^3$/m$^2$/24 h, 23° C. | Resistance to oil and grease, KIT-TEST | Resistance to temper-ature, DSC 25–300° C. |
|---|---|---|---|---|---|
| 1. Pigment SBS | 5 | 9 | 23 | 12 | No changes |
| 2. Dispersion coated | 4 | 3 | 30 | 12 | No changes |
| 3. Smooth cup board | 6 | 25 | 420 | 8 | No changes |

EXAMPLE 2

The solution is prehydrolyzed as in Example 1.

Instead of colloidal silica, small amounts of fine-grained talc, totalling 180 g, are added by agitating continuously, 98% of the grain size of the talc being less than 10 $\mu$m (Finntalc C10).

After methyl imidazole had been added to the mixture, its viscosity was adjusted to suit the rod coating by adding about 7 g of colloidal silica to it.

The coating solution was used to coat paperboard grades 1 and 3 according to Example 1. The coating was hardened and dried in the same conditions as in Example 1.

Test Results

When assessed visually, the coating is slightly matte and it has a good film forming ability.

The physical properties of the coating are presented in Table 2.

TABLE 2

The test results of Example 2

| Paper-board grade | Thickness of coating $\mu$m | Penetration of water vapor g/m$^2$/24 h | Pene-tration of oxygen cm$^3$/m$^2$/24 h | Resistance to oil and grease KIT-TEST | Resistance to temper-ature DSC 25–300° C. |
|---|---|---|---|---|---|
| 1. Pigment SBS | 10 | 11 | 33 | 12 | No changes |
| 3. Smooth cup board | 12 | 9.8 | 29 | 12 | No changes |

EXAMPLE 3

35.6 g of phenyltrimethoxy silane, 276.6 g of glycidyloxypropyltrimethoxysilane and 19.8 g of aminopropyltriethoxysilane were mixed in a vessel in an ice bath. 6 g of water was gradually added to this mixture by dropping and agitation in the ice bath was continued for 15 minutes, whereupon 12 g of water was added in small amounts and the mixture was further agitated in the ice bath for 15 minutes. Then 97.2 g of water was added by dropping it faster and agitation was continued for two hours at room temperature. Then 43.6 g of epoxy resin (Dow Corning D.E.R. 330) was added to this hydrolyzate. Coating was carried out on paperboards 1 to 3 according to Example 1 by using the rod coating method. The coating was cured in a furnace at 160 ° C. for three minutes.

TABLE 3

The test results of Example 3

| Paper-board grade | Thickness of coating $\mu$m | Penetration of water vapor g/m$^2$/24 h 23° C., 50% RH | Pene-tration of oxygen cm$^3$/m$^2$/24 h 23° C. | Resistance to oil and grease KIT-TEST | Resistance to temper-ature DSC 25–300° C. |
|---|---|---|---|---|---|
| 1. Pigment SBS | 4 | 10 | 25 | 12 | No changes |
| 2. Dis-persion-coated | 4 | 4 | 32 | 12 | No changes |
| 3. Smooth cup board | 6 | 12 | 35 | 12 | No changes |

EXAMPLE 4

The solution was prehydrolyzed as in Example 3. 147 g of mica (Kemira Mica 40) was added to the hydrolyzate. The coating solution was used to coat the paperboard grades 1, 2, and 3 according to Example 1. The coating was cured and dried as in Example 3.

Test Results

When examined visually, the coating is slightly matte and it has a good film forming ability. The physical properties of the coating are presented in Table 4.

TABLE 4

The test results of Example 4

| Paper-board grade | Thickness of coating μm | Penetration of water vapor g/m²/24 h, 23° C., 50% RH | Pene-tration of oxygen cm³/m²/24 h 23° C. | Resistance to oil and grease KIT-TEST | Resistance to temper-ature DSC 25–300° C. |
|---|---|---|---|---|---|
| 1. Pigment SBS | 5 | 8 | 20 | 12 | No changes |
| 2. Dispersion coated | 6 | 4 | 25 | 12 | No changes |
| 3. Smooth cup board | 6 | 10 | 30 | 12 | No changes |

It is clear to those skilled in the art that the different embodiments of the invention are not limited to the examples described above but can vary within the appended claims.

What is claimed is:

1. A method for manufacturing packaging board, in which a board base of paperboard or cardboard having a weight of at least 170 g/m² is provided with at least one silicon-based liquid tight and gas-tight layer of coating, which comprises the steps of:

providing a polymerizing reaction mixture containing at least one silicon compound to form an inorganic, chained or crosslinked polymeric backbone containing alternating silicon and oxygen atoms, and at least one organic compound to form organic side chains and/or crosslinks to the polymeric backbone, spreading said mixture on the board base, and curing said mixture to form a layer of coating.

2. A method according to claim 1, characterized in that the said organic compound contains at least one reactive epoxy, amino, hydroxyl, carboxyl, carbonyl, vinyl or methacrylate group.

3. A method according to claim 1, characterized in that at least one organosilane is included in the reaction mixture, forming a polymeric backbone and containing an epoxy, an amino, a hydroxyl, a carboxyl a carbonyl, a vinyl, or a methacrylate group which reacts with the said organic compound and/or forms crosslinks.

4. A method according to claim 1, characterized in that a metal compound is included in the reaction mixture, combining with the polymeric backbone so that part of the silicon atoms alternating with the oxygen atoms are replaced with metal atoms.

5. A method according to claim 1, wherein the organic compound comprises, calculated as a monomer, 5 to 80 molar percent of the total amount of said reaction mixture.

6. A method according to claim 1, characterized in that a polymerizing reaction mixture is spread on the board base, containing a liquid phase consisting of silane, a solvent, such as alcohol, water, and an organic compound and/or prepolymer, and the mixture is allowed to gel, whereupon the mixture is cured to form a tight layer of coating.

7. A method according to claim 6, wherein the mixture that is spread on the board is a colloidal mixture comprising a liquid phase containing monomers or prepolymers and colloidal particles.

8. A method according to claim 6, characterized in that the curing is carried out by heat at a setting temperature of about 100 to 200° C.

9. A method according to claim 6, characterized in that the curing is carried out by irradiation.

10. A method according to claim 1, characterized in that the weight of the thus formed layer of coating (9, 13) is at least 1 g/m², preferably about 2 to 6 g/m².

11. A method according to claim 1, wherein a filler selected from the group consisting of scale-like talc, mica, inorganic fibers and organic fibers, is also brought on the board base to form part of the layer coating.

12. A method according to claim 1, characterized in that the board base is printed and then a silicon-based, transparent liquid-tight and gas-tight coating layer is formed on the printed surface.

13. A method according to claim 1, characterized in that a joint-forming polymeric coating (6, 14) is spread on top of the previously formed silicon-based liquid-tight and gas-tight layer of coating (5, 13), the polymeric coating being used to close a package (1, 10).

14. A method for manufacturing a liquid-tight and gas-tight package, wherein a polymerizing reaction mixture is spread on paper or a board base of paperboard or cardboard, said mixture comprising at least one silicon compound forming an inorganic, chained or crosslinked polymeric backbone containing alternating silicon and oxygen atoms, and at least one reactive, organic compound forming organic side chains and/or crosslinks to the polymeric backbone, and that the reaction mixture is cured to form a layer of coating and that the package is formed partly or fully from the thus obtained polymer coated paper or board.

15. A foodstuff package, characterized in consisting of a jointed, oxygen-tight and aroma-tight paperboard or cardboard container (10), a small paperboard cup or a paper bag manufactured according to claim 14.

16. A foodstuff, a medicine or a cosmetics package (1), characterized in being formed according to claim 14 by closing its mouth by a jointed, oxygen-tight cover paper (3).

17. A foodstuff base, such as a microwave or conventional oven tray (7), characterized in consisting of a water-tight and grease-tight, heat-resistant packaging board manufactured according to any of claim 1.

18. A method according to claim 1, wherein said silicon compound is organosilane and said polymerizing reaction mixture is provided by first reacting said organosilane to form a polymeric backbone comprising inorganic silicon-oxygen chains, and then adding an organic compound to the mixture to continue the reaction by forming side chains and/or crosslinks between said inorganic silicon-oxygen chains.

19. A method according to claim 5 wherein the organic compound comprises, calculated as a monomer 10 to 50 molar percent, of the total amount of said reaction mixture.

20. A method according to claim 1 wherein said organic compound is selected from the group consisting of a prepolymer, an aromatic alcohol, an acrylate, a polyol and an isocyanate.

21. A method according to claim 1 wherein the silicon-based liquid tight and gas-tight layer of coating provides a tightness of 3–25 g/m²/24 h, 23° C., 50% RH for penetration of water vapor and 20–420 cm³/m²/24 h for penetration of oxygen.

* * * * *